US009878436B1

(12) United States Patent
Castro

(10) Patent No.: US 9,878,436 B1
(45) Date of Patent: Jan. 30, 2018

(54) HANDLE FOR A SCRUB BRUSH

(71) Applicant: Jeff Castro, Dallas, TX (US)

(72) Inventor: Jeff Castro, Dallas, TX (US)

( * ) Notice: Subject to any disclaimer, the term of this patent is extended or adjusted under 35 U.S.C. 154(b) by 0 days.

(21) Appl. No.: 15/265,960

(22) Filed: Sep. 15, 2016

Related U.S. Application Data

(63) Continuation-in-part of application No. 29/564,510, filed on May 13, 2016, which is a continuation of application No. 29/497,648, filed on Jul. 26, 2014, now Pat. No. Des. 759,978.

(51) Int. Cl.

| | |
|---|---|
| ***A46B 5/02*** | (2006.01) |
| ***B25G 1/04*** | (2006.01) |
| ***B25G 1/10*** | (2006.01) |
| ***A46B 5/00*** | (2006.01) |
| ***B25G 3/36*** | (2006.01) |
| ***A46B 9/02*** | (2006.01) |

(52) U.S. Cl.
CPC ..... *B25G 1/04* (2013.01); *A46B 5/0066* (2013.01); *A46B 5/0095* (2013.01); *A46B 9/02* (2013.01); *B25G 1/102* (2013.01); *B25G 3/36* (2013.01)

(58) Field of Classification Search
CPC ... A46B 5/0037; A46B 5/0066; A46B 5/0095; B25G 1/04; B25G 1/102
See application file for complete search history.

(56) References Cited

U.S. PATENT DOCUMENTS

| | | | | |
|---|---|---|---|---|
| 4,483,356 | A * | 11/1984 | Kales | A45D 34/04 132/320 |
| 4,809,388 | A * | 3/1989 | Dietrich | A46B 5/02 15/143.1 |
| 5,133,101 | A * | 7/1992 | Hauser | A47L 13/24 15/143.1 |
| 6,199,245 | B1 * | 3/2001 | Blessing | B25G 1/06 16/422 |
| 6,203,626 | B1 * | 3/2001 | Biggs | B25G 1/04 134/42 |
| 2010/0005607 | A1 * | 1/2010 | DelaBarre | A46B 5/02 15/143.1 |

* cited by examiner

*Primary Examiner* — Randall Chin
(74) *Attorney, Agent, or Firm* — Jeffrey Roddy

(57) ABSTRACT

A handle for a cleaning implement, particularly for a scrub brush includes a resilient handle having a c-shaped bend along its length. The c-shaped bend can be grasped by a user and the handle caused to rotate along an axis defined by the scrubbing end and an upper terminal end.

5 Claims, 6 Drawing Sheets

FIG.8a
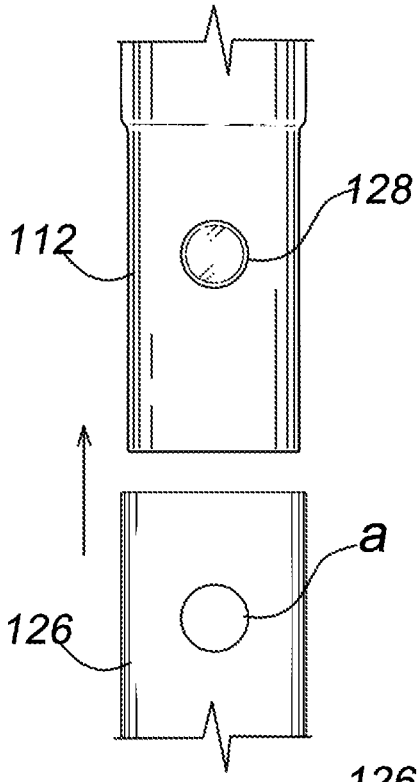
FIG.8b
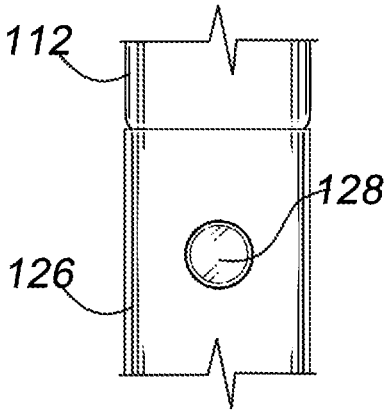
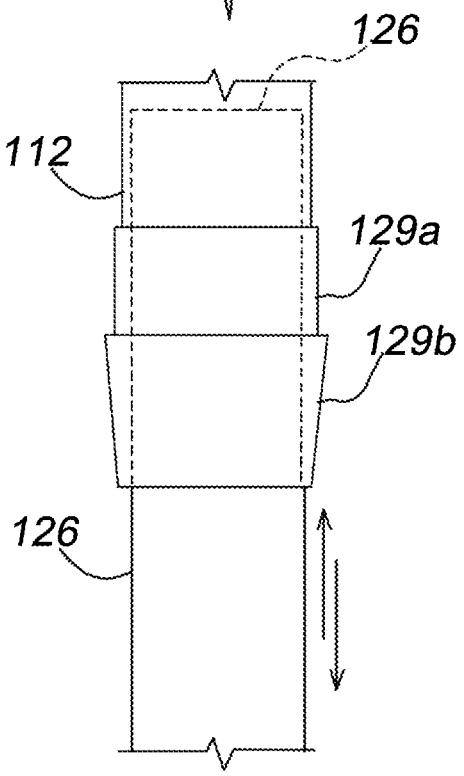
FIG.9a
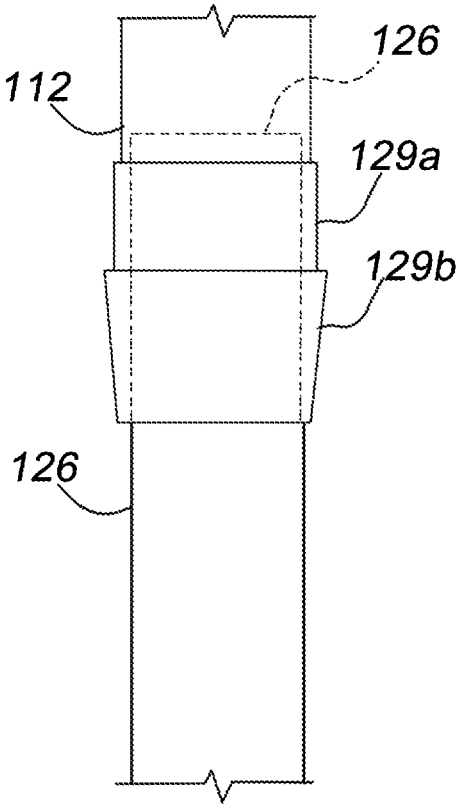
FIG.9b

HANDLE FOR A SCRUB BRUSH

CROSS REFERENCES TO RELATED APPLICATIONS

This application is a Continuation-in-part of U.S. Design application No. 29/564,510 of the same title and having a filing date of May 13, 2016, which is a Continuation of U.S. Design application No. 29/497,648 of the same title, having a filing date of Jul. 26, 2014, now U.S. Design Pat. No. D759,978

FIELD OF THE INVENTION

This invention relates to cleaning implements and handles therefor.

BACKGROUND OF THE INVENTION

Handles for cleaning implements, particularly scrub brushes are long known in the art. Typically, such handles may be short or long, have certain hand grip portions and come in a variety of sizes and shapes and materials. Despite a myriad of handle types, cleaning corners, whether the sharp corners of a wall or the rounded corners of a bathtub, presents problems for general purpose cleaning tools employing a substantially straight handle. To clean thoroughly, multiple attack directions including forcefully twisting the scrub brush must be employed which often require the operator to manipulate the cleaning implement while in awkward positions. Some solutions for operator fatigue have been out forth. U.S. Pat. No. 5,606,772 by Ilic discloses a universal handle grip for tools that includes a primary hand grip with multiple angles. While no doubt useful for many cleaning operations, the Ilic handle does not facilitate twisting the scrub brush.

What is needed is a handle assembly for a scrub brush that will facilitate common scrubbing operations such as back and forth straight-line scrubbing, and also permit the user to continuously twist the handle and an attached scrub brush against a targeted spot for cleaning, or, intermittently twist the handle and scrub brush along with other scrubbing lines of attack.

It would be desirable if the foregoing handle assembly were to permit a user to maintain a natural grip without straining the wrist or forearm.

It would be especially desirable if the foregoing handle assembly were resilient, portions of which bowing in response to force applied, and snapping back into position when force is relieved in order to permit a user applying his/her body weight to bear into the tool as a means to apply consistent scrubbing action when force is both applied and relieved.

It would be further desirable if the resilient handle were provided with a integrated curving portion defining a spring that would flex, compress and snap back into position when force is applied along a length of the handle, to mitigate user fatigue.

It would be particularly desirable if portions of the foregoing handle assembly were capable of accepting different scrubbing heads and telescoping.

SUMMARY OF THE INVENTION

In the present invention, a handle assembly for a scrub brush includes a specially shaped resilient handle with a bend therein which permits a user to forcefully twist the scrubbing end of a cleaning implement continuously for a stand-alone cleaning motion, or in combination with other scrubbing lines of attack, as a means to remove difficult stains from irregularly shaped surfaces.

In some embodiments the scrub brush handle is an otherwise straight section of resilient cylindrical material such as steel tubing or fiberglass having a substantially c-shaped bend along its length. Depth of the bend may vary.

In some embodiments a c-shaped bend in a scrub brush handle has a upper bend portion and a lower bend portion wherein the lower portion projects transversely from the remainder of the handle.

In some embodiments a projecting member forms an auxiliary hand grip that extends transversely from the scrub brush handle, while in other embodiments, an auxiliary hand grip is reversibly attachable to the scrub brush handle. Reversible attachment of the auxiliary hand grip may be by clamping, e.g., a clam shell fitting about the handle, or the handle may be held on with a threaded fastener. Other attachment means for an auxiliary hand grip will suggest themselves to those having skill in the art.

In some embodiments the scrub brush handle terminates at an upper end (FIG. 6). In some embodiments, an upper portion of the scrub brush handle is shaped and sized to be easily spun when loosely grasped by a hand. While in the embodiments depicted herein, the upper hand grip is substantially spherical, other hand grips having an smooth or curving upper surface adapted for a user to bear against with the palm of a hand are suitable for use in the present invention. In some embodiments the upper hand grip is fixed, while in some embodiments, the upper hand grip is adapted to rotate independently of the handle. In such cases, the upper hand grip may include a recess that receives a cylindrical end or stub of the scrub brush handle adapted to rotate within the recess or else employ other couplings including bearings, bushings or other elements permitting rotation about a fixed axis that will suggest themselves to those having skill in the art. In some embodiments, the upper hand grip is reversibly attachable (FIG. 6).

The handle of the present invention is resilient, meaning that it has some spring and when deformed within limits, will return to its customary shape. The c-shaped bend will compress slightly when weight is applied to the upper end of the scrub brush handle, and will spring back when the applied weight is gradually relieved. This causes the scrubbing end to slip slightly while under force thus applying relatively greater force to a spot; e.g., a stain, than one would obtain with a static handle. Another aspect of the spring action of the c-shaped bend is that when weight bearing force is lessened at the top end of the handle, the tendency of the c-shaped bend is to snap quickly back into position, effectively pushing back toward the user. This feature helps to mitigate fatigue when a user is required to repeatedly "lean" on one end of the handle in order to scrub difficult areas, by springing back into position when sufficient force is relieved, giving the user a "boost."

In some embodiments portions of the handle nearest the scrubbing end telescope. In some embodiments portions of the handle are reversibly attachable so that different scrubbing heads are easily interchanged.

Other advantages of the present invention will become apparent from the following descriptions, taken in connection with the accompanying drawings wherein by way of illustration and example, preferred embodiments of the present invention are disclosed.

BRIEF DESCRIPTION OF THE DRAWINGS

FIGS. 8A and 8*b* show a stepwise attachment process for lower handle body 112 and brush section member 126 wherein aperture (a) is slid over spring button 128;

FIGS. 9A and 9*b* show a telescoping embodiment wherein brush section member 126 telescopically extends from lower handle body 112;

DETAILED DESCRIPTION OF THE INVENTION

Reference Listing

Figure 1:
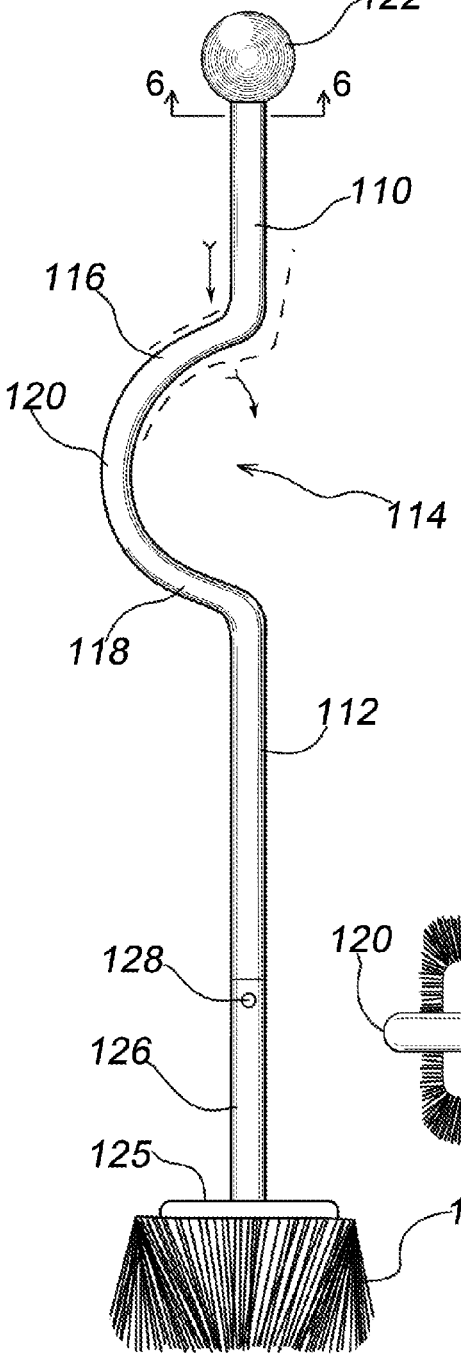
FIG. 1 shows a side plan view of one embodiment according to the present invention.

110 upper handle body
112 lower handle body
114 bend
116 upper bend
118 lower bend
120 outermost section of bend
122 upper hand grip
124 scrub brush
125 brush plate
126 brush section member
128 spring button
129*a* collar
129*b* collet
130 auxiliary hand grip
131 integrated hand grip
132 clamp

Definitions

Unless otherwise explained, any technical terms used herein have the same meaning as commonly understood by one of ordinary skill in the art to which this disclosure belongs. The singular terms "a," "an," and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes." All publications, patent applications, patents, and other references mentioned herein are incorporated by reference in their entirety for all purposes. In case of conflict, the present specification, including explanations of terms, will control. In addition, the materials, methods, and examples are illustrative only and not intended to be limiting. The following description and the drawings sufficiently illustrate specific embodiments to enable those skilled in the art to practice them. Other embodiments may incorporate structural, logical, electrical, process, and other changes. Examples merely typify possible variations. Individual components and functions are optional unless explicitly required, and the sequence of operations may vary. Portions and features of some embodiments may be included in, or substituted for, those of other embodiments. Embodiments set forth in the claims encompass all available equivalents of those claims.

Referring generally to FIGS. 1-11, a handle for a cleaning implement includes a resilient body having a bend 114 with an upper bend portion 116 and a lower bend portion 118 along its length wherein any portion of the bend may be grasped by a user, a scrubbing end—typically including a brush plate 125, scrub brush head 124, and a terminal upper end to which a upper hand grip 122 may be affixed.

Figure 2:
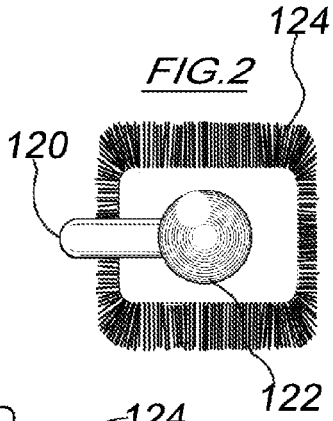
FIG. 2 shows an end view of the embodiment shown in (FIG. 1)
Figure 3:
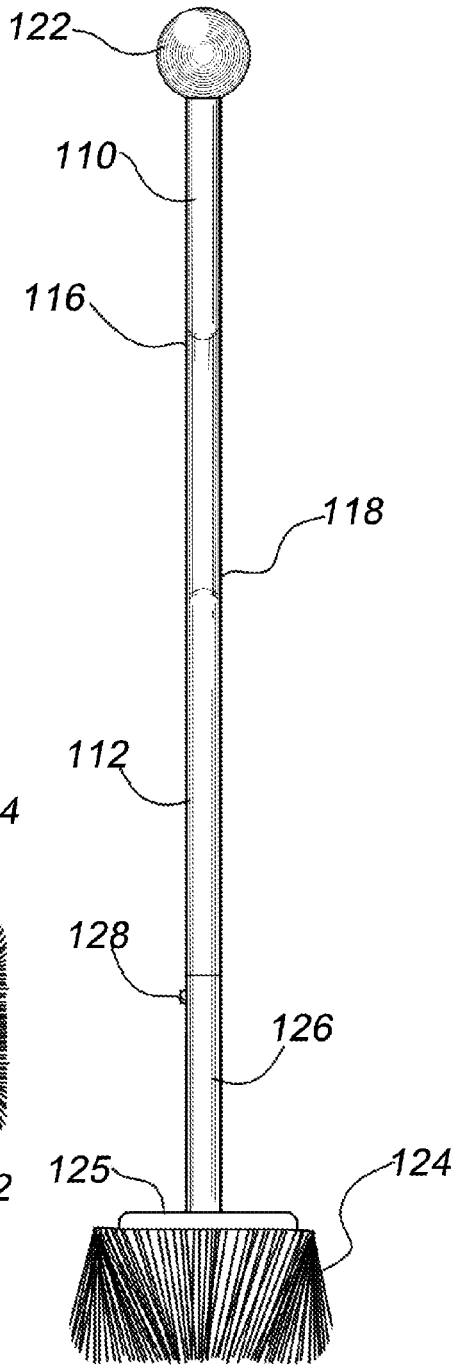
FIG. 3 is a side view thereof with the handle rotated on its axis 90 degrees clockwise from the position shown in (FIG. 1)

FIGS. 1-3 show an embodiment having an upper handle portion 110, a lower handle portion 112 and a scrub brush section 126. In this case, the lower handle portion tapers (see FIG. 8*a*) and is sized to slip within section 126 wherein the two sections are coupled by spring button 128 aligned with aperture (a). This arrangement permits different brush sections to be interchanged easily and quickly as required by the particular cleaning task. It should be noted that the position of the taper along lower handle portion 112 can vary as can the number of apertures along brush section 126.

Figure 4:
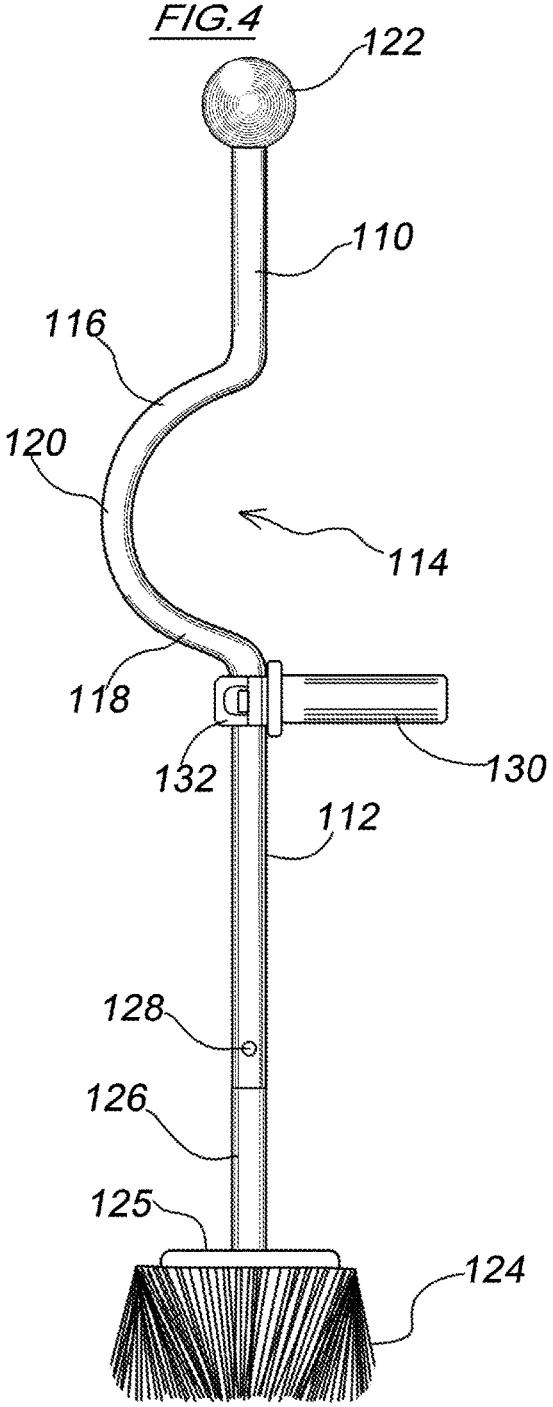
FIG. 4 a side plan view of another embodiment according to the present invention.
Figure 5:
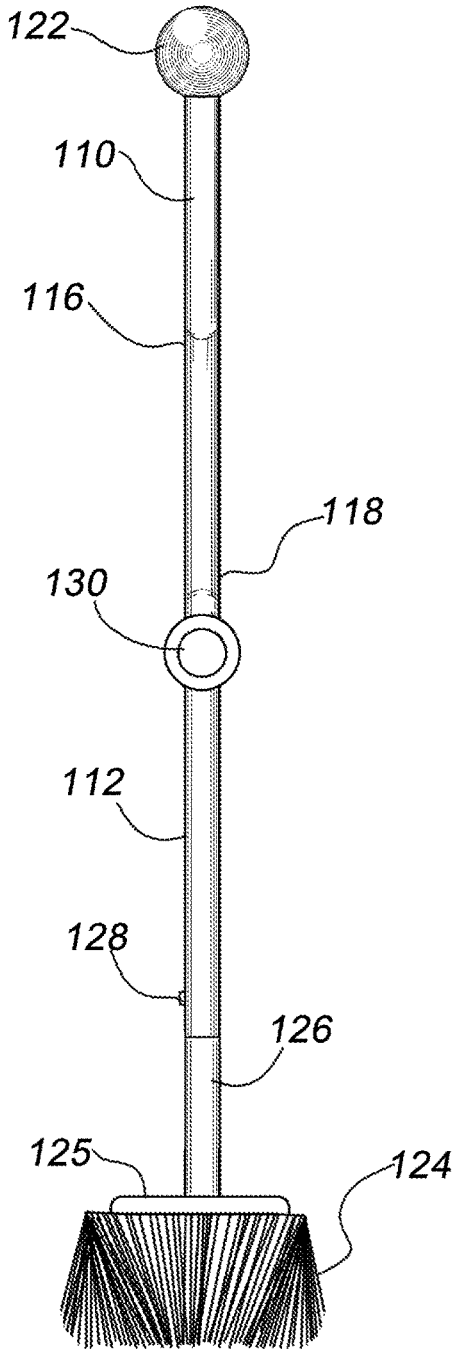
FIG. 5 is a side view thereof with the handle rotated on its axis 90 degrees clockwise from the position shown in (FIG. 4)

FIGS. 4 and 5 show an embodiment having an auxiliary handle 130 fitted adjacent lower bend 118. Although the embodiment shows auxiliary handle 130 generally co-planar with the bend, the handle may be positioned at any point around the scrub brush handle. Preferably auxiliary handle is secured by a clamp 132. However, auxiliary handle 130 may include a threaded post (not shown) that threads into a threaded recess (not shown) of the handle, or other suitable means of attachment.

Figure 6:
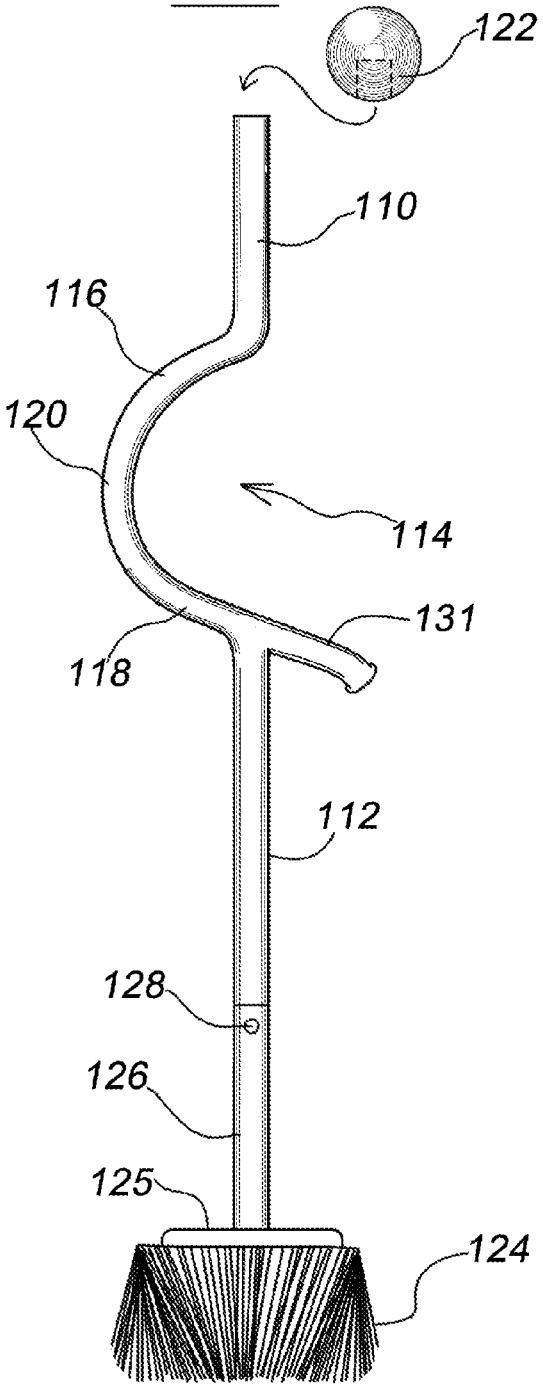
FIG. 6 a side plan view of another embodiment according to the present invention.
Figure 7:
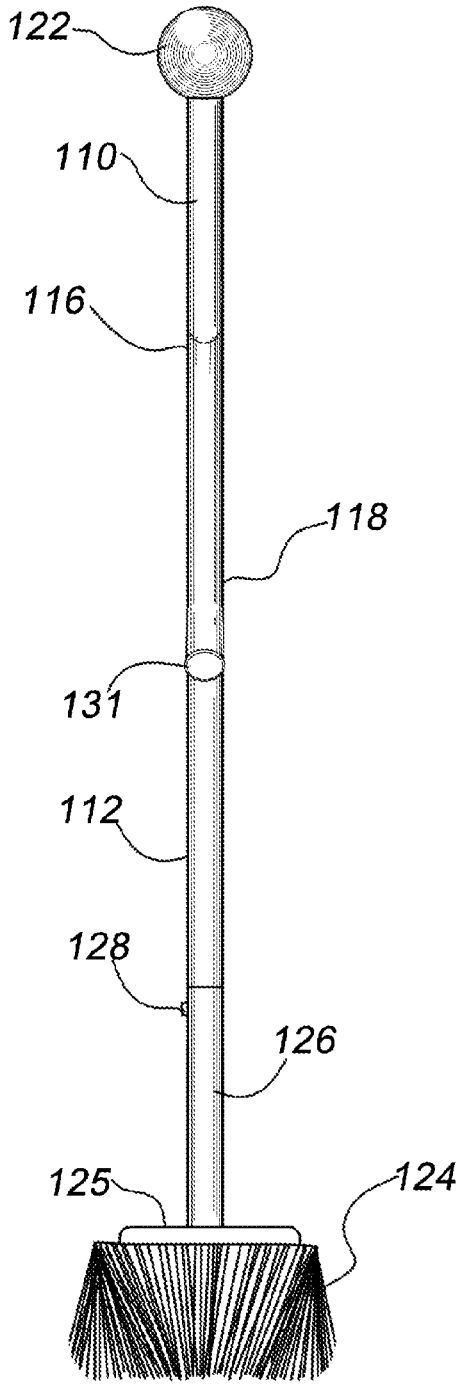
FIG. 7 is a side view thereof with the handle rotated on its axis 90 degrees clockwise from the position shown in (FIG. 6)

FIGS. 6 and 7 show an embodiment wherein integrated hand grip 131 projects from lower bend 118 in a substantially downward direction. Although the embodiment shows handle 131 co-planar with the bend, the handle may be formed at any point around the scrub brush handle below lower bend portion 118.

In enlarged partial views of handle sections 112, 126, FIGS. 9A and 9*b* show one possible configuration of a telescoping handle wherein lower handle body 112 possesses a greater diameter than scrub brush section 126 which telescopes therefrom and is positioned by extending or retracting when collar 129*a* is twisted to loosen collet 129*b*. It should be understood that the telescoping configuration shown is merely exemplary, and other telescoping configurations will suggest themselves to those having skill in the art.

Figure 10:
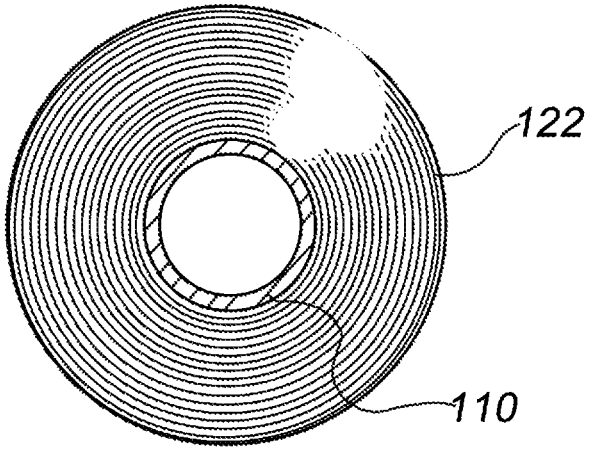
FIG. 10 is a sectional view taken along lines 6'-6' of (FIG. 1)

FIG. 10 is a sectional view taken along lines 6'-6' of (FIG. 1), showing a section of handle 110 extending into grip 122.

Figure 11:
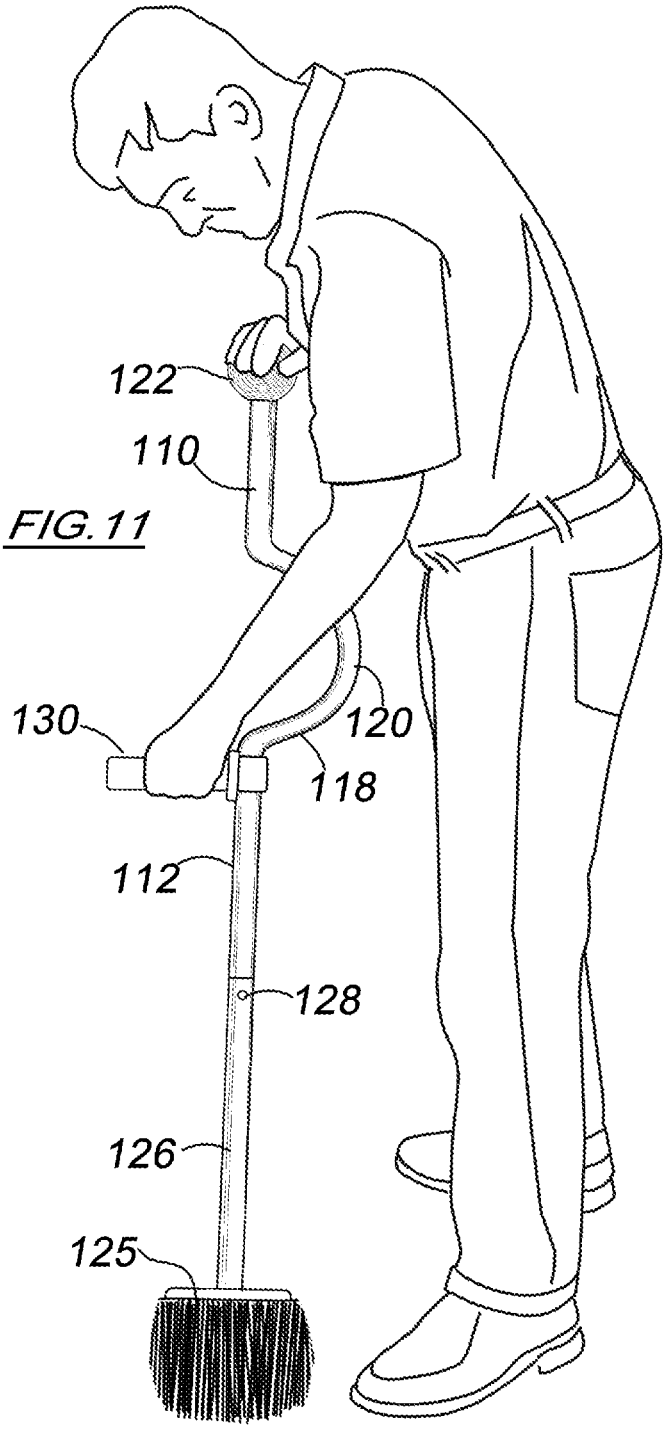
FIG. 11 shows an embodiment according to the present invention in a typical use setting.

FIG. 11 shows one embodiment according to the present invention in a typical use setting.

Materials for the handle 110, and the hand grips 122, 130 and 131 may vary. Lower handle portion 112 may extend all the way to the scrub brush 124 which may be permanently fixed thereon 112 or reversibly attachable thereto; e.g., via brush plate 125 which may be adapted by threading or otherwise to be attached and removed from handle section 112. The overall length of handle 110 may vary. The position of bend 114 along handle 110 may vary. The shape, size, bristle arrangement and bristle stiffness of scrub brush 124 may vary.

It should be understood that the drawings and detailed description herein are to be regarded in an illustrative rather than a restrictive manner, and are not intended to be limiting to the particular forms and examples disclosed. Accordingly, it is intended that this disclosure encompass any further modifications, changes, rearrangements, substitutions, alternatives, design choices, and embodiments as would be appreciated by those of ordinary skill in the art having benefit of this disclosure, and falling within the spirit and scope of the following claims.

What is claimed is:

1. A handle for a cleaning implement to mitigate user fatigue comprising:

(1) a resilient cylindrical body including: an otherwise continuously straight handle with a discontinuous portion defined by a c-shaped bend having an upper curving portion and a lower curving portion, and a first straight section is adapted to extend from the upper curving portion and a second straight section is adapted to extend from the lower curving portion, and the first straight section and second straight section are in coaxial alignment when the resilient cylindrical body is in a relaxed state;

(2) a first end of the resilient cylindrical body having a first grip member for applying force thereagainst;

(3) a scrubbing member at a second end of the resilient cylindrical body; and, wherein the first end and the second end are at opposite ends of the resilient cylindrical body, and the c-shaped bend is resiliently compressible when force is applied at the first end in a direction toward the scrubbing member, and the first straight section and the second straight section are configured to spring back into coaxial alignment when the force is relieved.

2. The handle according to claim 1 wherein portions of the c-shaped bend define a second grip member.

3. The handle according to claim 1 comprising a grip member that extends from the lower curving portion.

4. The handle according to claim 1 wherein the scrubbing member is attachable to, and detachable from the body.

5. The handle according to claim 1 further comprising an extended or telescoping portion.

* * * * *